US005528562A

United States Patent [19]

Suzuki

[11] Patent Number: 5,528,562

[45] Date of Patent: Jun. 18, 1996

[54] MIMIC WATCH SET FOR MAGIC USE

[75] Inventor: Tooru Suzuki, Tokyo, Japan

[73] Assignee: Tenyo Co., Ltd., Tokyo, Japan

[21] Appl. No.: 506,598

[22] Filed: Jul. 25, 1995

[30] Foreign Application Priority Data

Jul. 25, 1994 [JP] Japan ..... 6-172195

[51] Int. Cl.[6] ..... G04B 37/00; G09F 9/00

[52] U.S. Cl. ..... 368/276; 368/283; 116/308

[58] Field of Search ..... 368/76, 80, 45, 368/223–225, 276–278, 283, 286; 116/308

[56] References Cited

U.S. PATENT DOCUMENTS

| | | | |
|---|---|---|---|
| 1,907,700 | 5/1933 | Alix | 368/283 |
| 2,384,549 | 9/1945 | Godin | 368/286 |
| 3,584,455 | 6/1971 | Slon | 368/283 |
| 4,444,513 | 4/1984 | Proellochs et al. | 368/223 |
| 5,206,841 | 4/1993 | Boucheron | 368/276 |

*Primary Examiner*—Vit W. Miska

*Attorney, Agent, or Firm*—Sixbey, Friedman, Leedom & Ferguson; Gerald J. Ferguson, Jr.

[57] ABSTRACT

In a mimic watch having hour numerals "1" to "12" marked therein, a rotary disk having an hour hand fixed thereon is installed rotatably. When used for a play, the mimic watch is put into a protective case. Watching the hour hand and numerals through the rear transparent case member of the protective case, the player operates an operating string loop, with care for the audience not to be aware of the player's operation, to set the hour hand to a numeral the audience has selected. At this time, only the hour numerals will be visible through the transparent area on the front transparent case member of the protective case but an opaque area formed on the front transparent case member will hide the hour hand on the rotary disk being rotated. When the mimic watch taken out of the protective case is shown to the audience, the audience will see the hour hand point at the numeral he or see has selected, which will give the audience an illusion that the mimic watch has automatically pointed at that numeral.

4 Claims, 6 Drawing Sheets

MIMIC WATCH SET FOR MAGIC USE

The present invention relates to a mimic watch set for magic use to have a mimic-watch hour hand point at a numeral the audience has selected from among hour numerals marked on a dial or a similar member of the mimic watch.

SUMMARY OF THE INVENTION

The present invention has an object to provide a mimic watch set for magic use, simply constructed and easy to use.

The mimic watch set according to the present invention comprises a mimic watch with a rotary disk carrying an hour hand and an operating string loop, and a protective case for the mimic watch.

The mimic watch is composed of a front case frame/cover member and a rear case frame/cover member, which define together an inner space of the mimic watch. Each of the front and rear case frame/cover members consists of an opaque case frame portion and a central transparent cover portion. The central transparent cover portion of the front or rear case frame/cover member has twelve hour numerals "1" to "12" marked circumferentially thereon along the opaque case frame portion thereof. The hour numerals are in normal postures when viewed from the front of the mimic watch.

The rotary disk is composed of a central transparent disk portion corresponding to both the central transparent cover portions of the front and rear case frame/cover members, and an annular plate portion fixed to the circumference of the central transparent disk portion. The rotary disk is so disposed in the inner space of the mimic watch as to be rotatable about an axis thereof extending perpendicularly to, and through the centers of, the transparent disk portion thereof and the central transparent cover portions of the front and rear case frame/cover members. In addition, the rotary disk has an hour hand fixed on the transparent disk portion thereof. The hour hand extends radially from the center of rotation of the rotary disk to a position a little short of the hour numerals on the central transparent cover portion of the front or rear case frame/cover member.

The operating string loop is provided as wound inside the annular plate portion of the rotary disk inside the mimic watch. It is fixed at one place to the annular plate portion of the rotary disk. The portion of the string loop other than laid wound around the annular plate portion of the rotary disk is led out of the mimic watch.

The protective case is composed of an opaque front case member to cover the front case frame/cover member of the mimic watch, a rear case member and a side case member. The protective case is open at a portion of the side case member between the front and rear case members. Thus the mimic watch can be put into and taken out of the protective case through the opening. The opaque front case member is partially transparent in a range through which it is possible to see the hour numerals marked on the central transparent cover portion of the front or rear case frame/cover member of the mimic watch. Also the rear case member is partially transparent in a range through which the above-mentioned hour numerals and hand can be seen from outside.

As having been described in the foregoing, both the hour numerals "1" to "12" and hour hand are visible through the central transparent cover portions of the front and rear case frame/cover members. However, when the mimic watch is put in place in the protective case, only the hour numerals "1" to "12" can be seen through the transparent area of the front case member of the protective case and both the hour numerals and hand are visible through the transparent area of the rear case member. By pulling the operating string loop portion led out of the mimic watch, the rotary disk can be rotated relative to the front and rear case frame/cover members for the hour hand to point at a desired one of the hour numerals on the central transparent cover portion of the front or rear case frame/cover member.

How the foregoing and other more specific objects of the present invention are achieved will appear in the ensuing more detailed description of an illustrative embodiment of the invention which will now be set forth in reference to the drawings.

DETAILED DESCRIPTION OF THE PREFERRED EMBODIMENT

Figure 1:
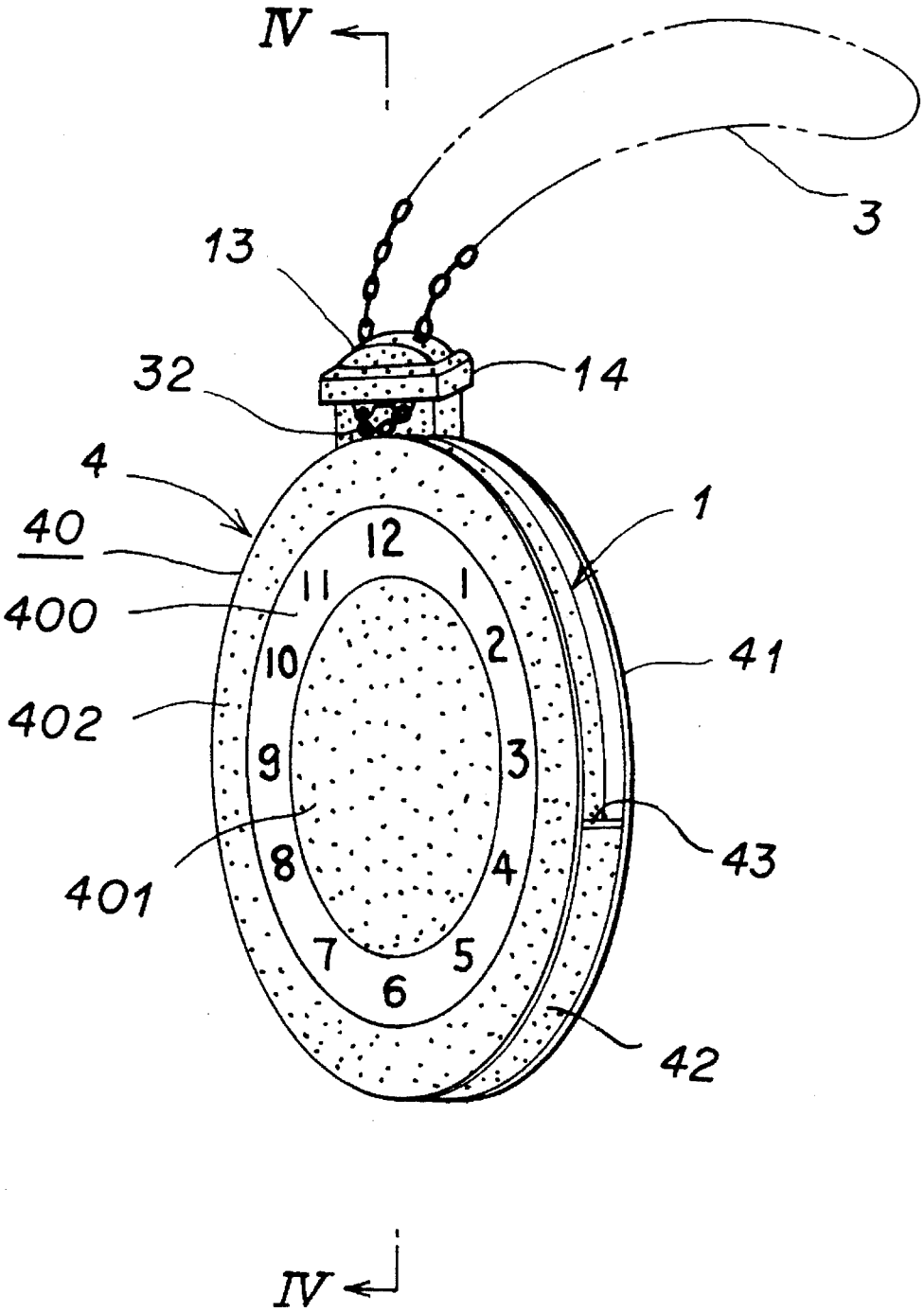
FIG. 1 is a perspective view of an embodiment of the mimic watch for magic use according to the present invention, showing the mimic watch put in place in the protective case.
Figure 2:
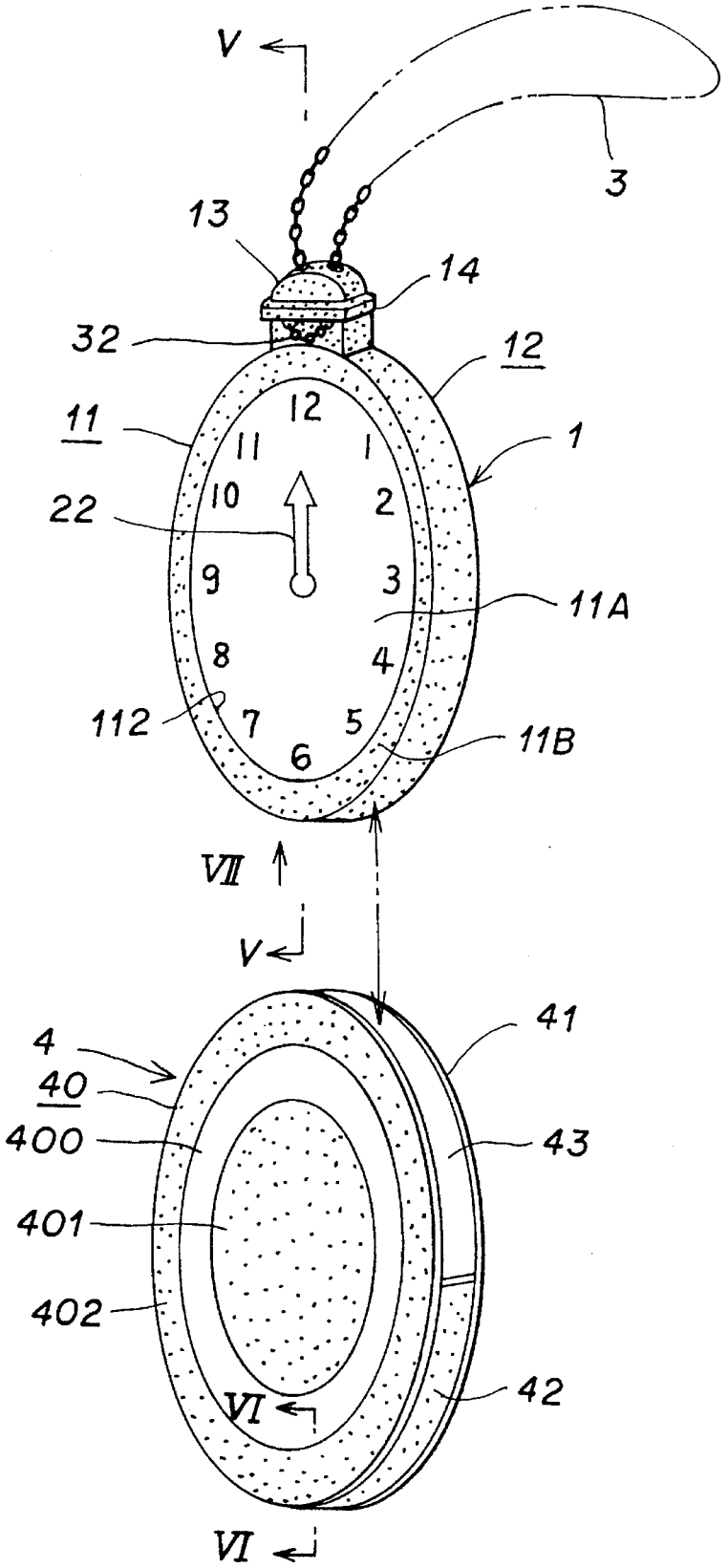
FIG. 2 is a perspective view showing the mimic watch taken out of the protective case.
Figure 3:
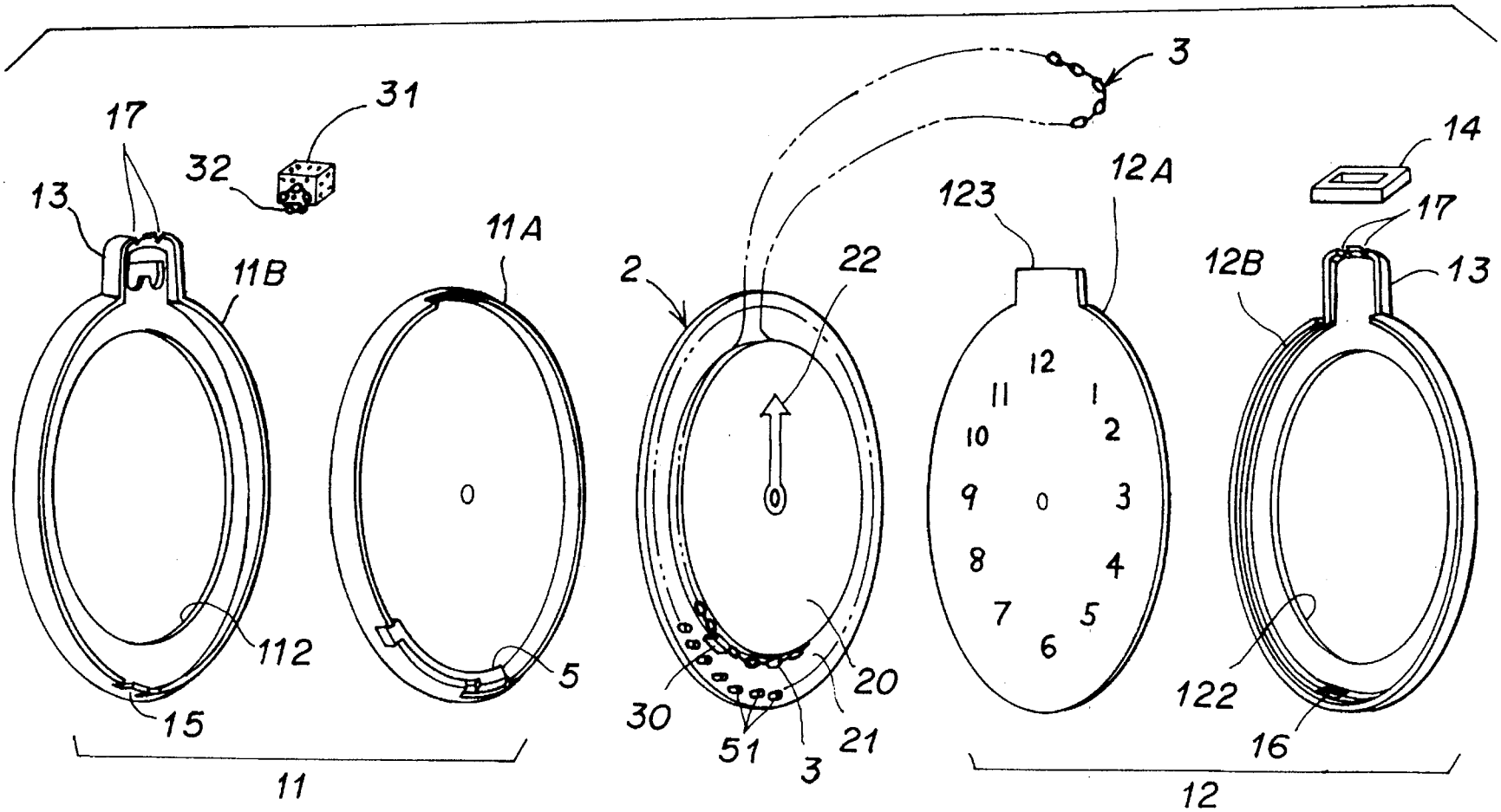
FIG. 3 is an exploded perspective view of the mimic watch and rotary disk.
Figure 4:
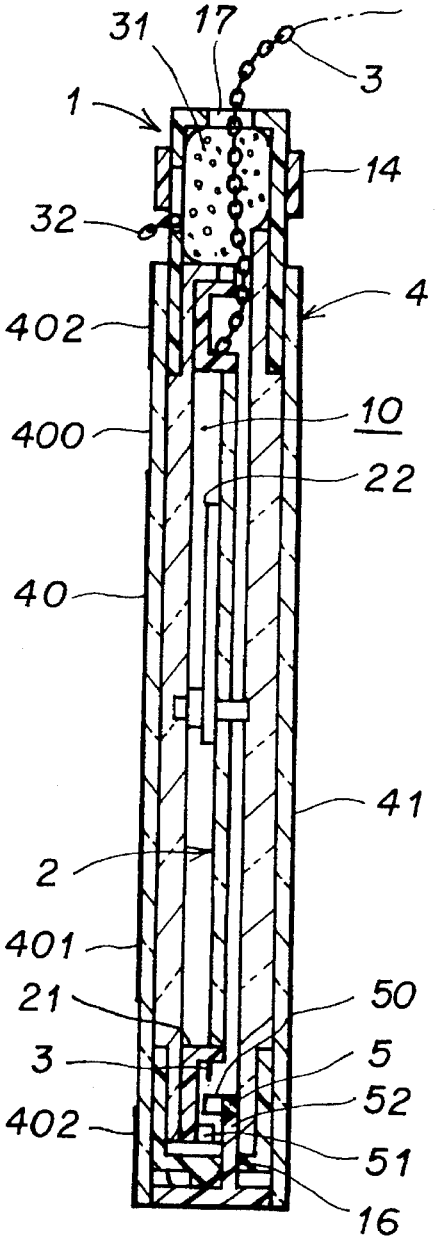
FIG. 4 is a sectional view taken along the line IV—IV in FIG. 1.
Figure 10:
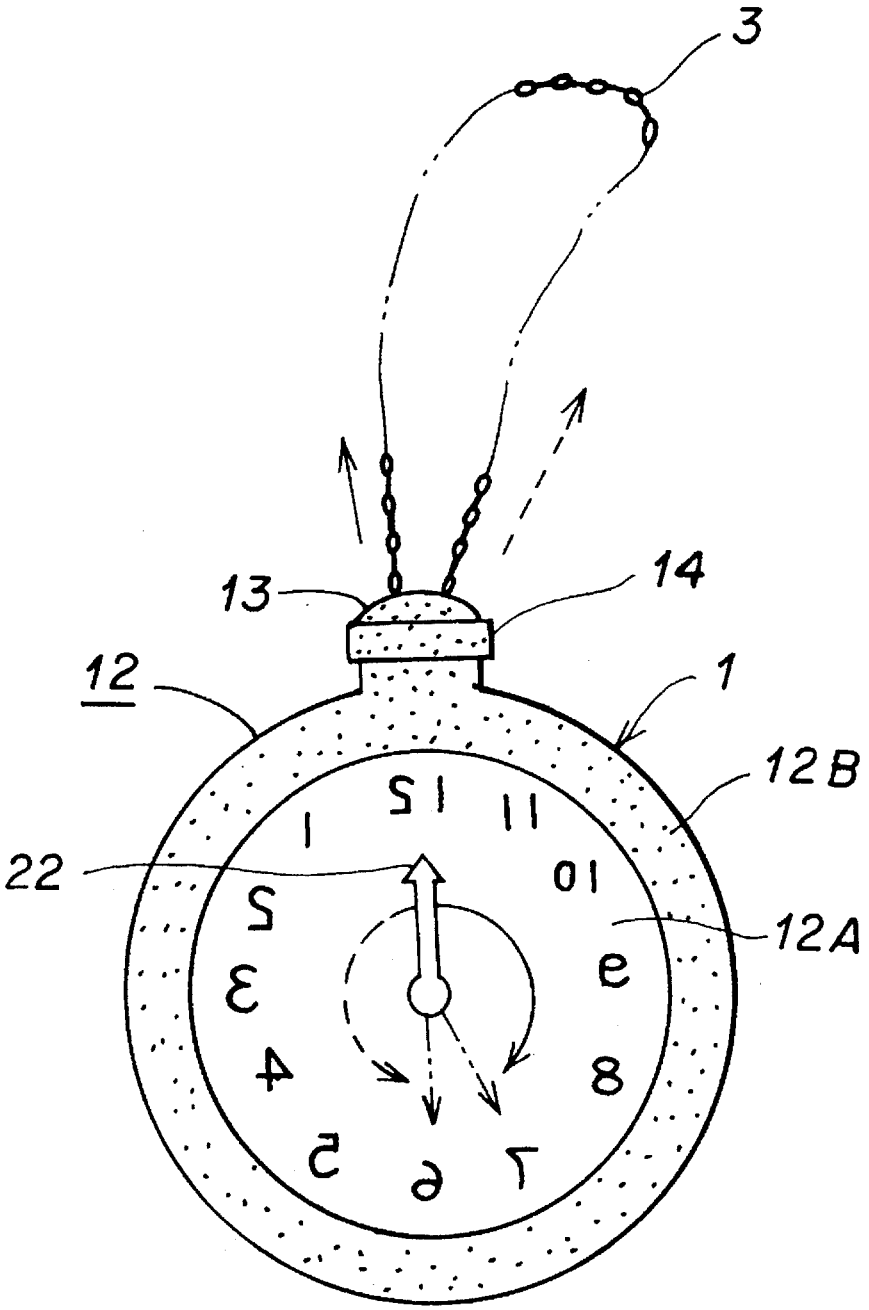
FIG. 10 is an explanatory drawing showing the rotary disk being rotated by using the chain.

In FIGS. 1, 2 and 10, the portions smudged with small dots indicate opaque portions. Through Figures, the reference numeral 1 indicates a mimic watch. The mimic watch 1 has the form of a disk and comprises a front case frame/cover member 11 and a rear case frame/cover member 12, which define an inner space 10 between them, as shown in FIG. 2.

The front case frame/cover member 11 is comprised of a central transparent cover portion 11A having the form of a short hollow cylinder open at the back thereof, and an opaque case frame portion 11B having the form of a ring with a circular opening 112 in the center thereof. The central transparent cover 11A and opaque case frame 11B are integrally fixed to each other.

The rear case frame/cover member 12 is composed of a central transparent cover portion 12A having the form of a short hollow cylinder open at the back thereof, and an opaque case frame portion 12B having the form of a ring with a circular opening 122 in the center thereof. The central transparent cover 12A and opaque case frame 12B are integrally fixed to each other.

Each of the opaque case frames 11B and 12B has a projection 13 formed on the top thereof. There is provided a retaining ring 14 which is to be fitted on the projections (crown/crown stem) 13. The opaque case frame 11B has a pawl 15 formed at the bottom thereof while the opaque case frame 12B has a through-hole 16 formed in the bottom thereof. The pawl 15 is to be engaged on the edge of the through-hole 16. In order to assemble the front and rear case frame/cover members 11 and 12 to each other into the mimic watch 1, the pawl 15 of the opaque case frame 11B is fitted into the through-hole 16, the front and rear case frame/cover members 11 and 12 are pressed to each other, and then the retaining ring 14 is fitted onto the projections 13. Thus, the central transparent cover 11A and opaque case frame 11B of the front case frame/cover member 11 are assembled to the central transparent cover 12A and opaque case frame 12B, respectively, of the rear case frame/cover member 12 to form the mimic watch 1.

The central transparent cover (dial) 12A of the rear case frame/cover member 12 has hour numerals "1" to "12" marked thereon along the circumference thereof. The hour numerals "1" to "12" are disposed as regularly spaced circumferentially on the central transparent cover 12A, and take normal postures when viewed from the front of the central transparent cover 11A of the front case frame/case member 11.

There is provided in the inner space 10 of the mimic watch 1 a rotary disk 2 rotatable about an axis thereof extending perpendicularly to, and through the centers of, the central transparent covers 11A and 12A.

The rotary disk 2 is composed of a transparent disk 20 corresponding to the circular openings 112 and 122 of the opaque case frames 11B and 12B and an annular plate 21 fixed to the circumference of the transparent disk 20. The annular plate 21 may be transparent or opaque.

The transparent disk 20 has an hour hand 22 fixed thereon. The hour hand 22 extends radially from the center of rotation of the rotary disk 2 to a position a little short of the hour numerals marked on the central transparent cover 12A of the rear case frame/cover member 12.

The rotary disk 2 is rotated by operating the opening string loop 3 which is an endless chain, for example.

The chain 3 is disposed as wound inside the annular plate 21 along the circumference of the transparent disk 20 within the mimic watch 1, and fixed at one place (indicated at 30) to the annular plate 21. The portion of the chain 3 other than laid wound inside the annular plate 21 is led out of the inner space 10 of the mimic watch 1 through holes 17 in the projections (crown/crown stem) 13.

The place 30 where the chain 3 is fixed to the rotary disk 2 is at about 195° clockwise from the hour hand 22 when viewed from the back of the mimic watch.

During a magic play, the mimic watch 1 is to be put into and taken out of the protective case 4. The protective case 4 is a hollow disk a little larger in size than the mimic watch 1.

The protective case 4 is composed of a transparent front case member 40, a transparent rear case member 41, and a semi-circular opaque side case member 42. The side case member 42 is fixed along a half of the circumference of the front and rear case members 40 and 41. Thus, the protective case 4 is open (as indicated with 43) along the other half of the circumference of the front and rear case members 40 and 41, that is, between the opposite ends of the side case member 42 as well as between the front and rear case members 40 and 41. Thus, the mimic watch can be put into the protective case 4 through the opening 43.

The transparent front case member 40 is partially opaque in a central circular area 401 having a radius a little larger the length of the hour hand 22 as well as in an annular peripheral area 402. These opaque areas 401 and 402 are provided on the front case member 40 by printing or coating an opaque material, by applying an opaque tape or by any other appropriate manner. Thus the front case member 40 has formed thereon an annular front transparent area 400 through which only the above-mentioned hour numerals are visible from outside.

Figure 7:
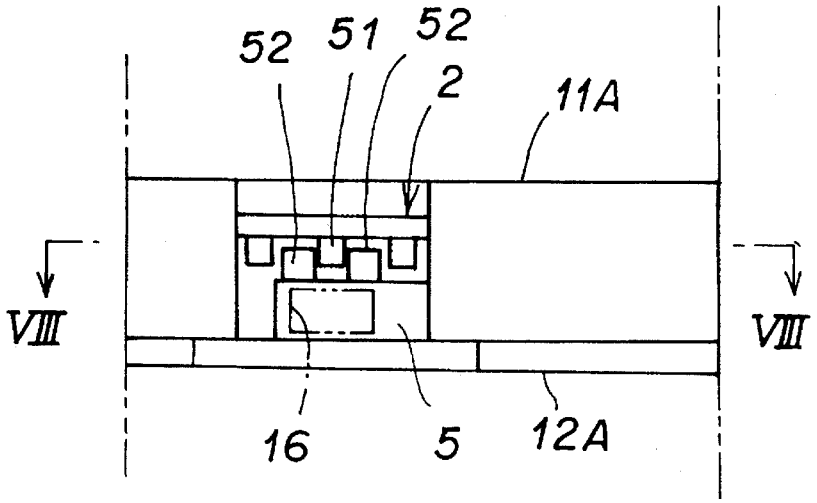
FIG. 7 is a view from the arrow VII in FIG. 2.
Figure 8:
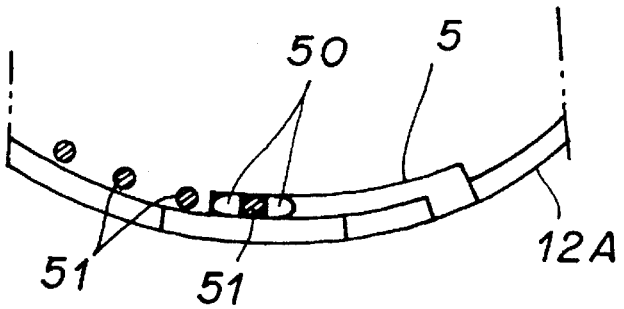
FIG. 8 is a sectional view taken along the line VIII—VIII in FIG. 7, showing the rotary disk locked against rotation.
Figure 9:
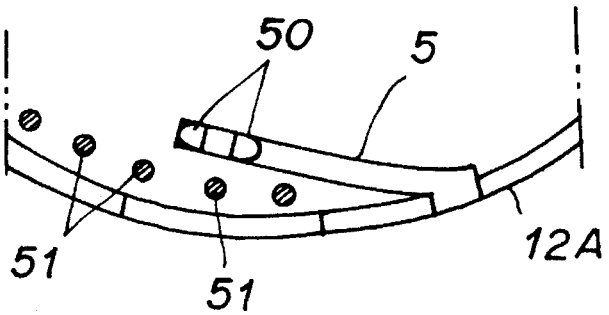
FIG. 9 is an explanatory drawing showing the rotary disk released from the locked state in FIG. 8.

There is provided between the mimic watch 1 and rotary disk 2 a locking member to block the rotary disk 2 from rotating. As shown in FIGS. 7 to 9, the locking member is composed of an elastic plate 5 fixed at one end thereof to the central transparent cover 11A and having two pawls 50 formed as spaced from each other at the other end thereof, and a plurality of small pins 51 disposed as regularly spaced on the annular plate 21 along the circumference of the latter. When one of the small pins 51 is caught between the two pawls 50 as shown in FIG. 8, the rotary disk 4 is locked against any rotation relative to the mimic watch 1.

The protective case 4 has provided thereon a means of releasing the rotary disk 4 from the above-mentioned locked state. The unlocking means consists of projections 52 formed on the inner wall of the side case member 42 of the protective case 4. When the mimic watch 1 is put into the protective case 4; the projections 52 abut the above-mentioned elastic plate 5 through the through-hole 16 in the opaque case frame 12B to resiliently deflect the elastic plate 5, where the one of the small pins 51 that has been caught between the two pawls 50 of the elastic plate 5 are released from between the pawls 50. Thus, the rotary disk 4 is released from the above-mentioned locked state and becomes freely rotatable (as shown in FIG. 9).

A cushion member 31 such as a sponge or the like is provided between the projections (crown/crown shaft) 13 of the opaque case frames 11B and 12B. The chain 3 is passed through this cushion member 31, so that the cushion material 31 will prevent a sound from being produced by a friction or contact between the chain 3 and projections 13 when the chain 3 is operated.

A mimic chain 32 is fixed to the projections 13 of the opaque case frame 11B of the mimic watch 1. The mimic chain 31 remains not moved when the chain 3 is operated to give an impression that the chain 3 is not operated.

Figure 5:
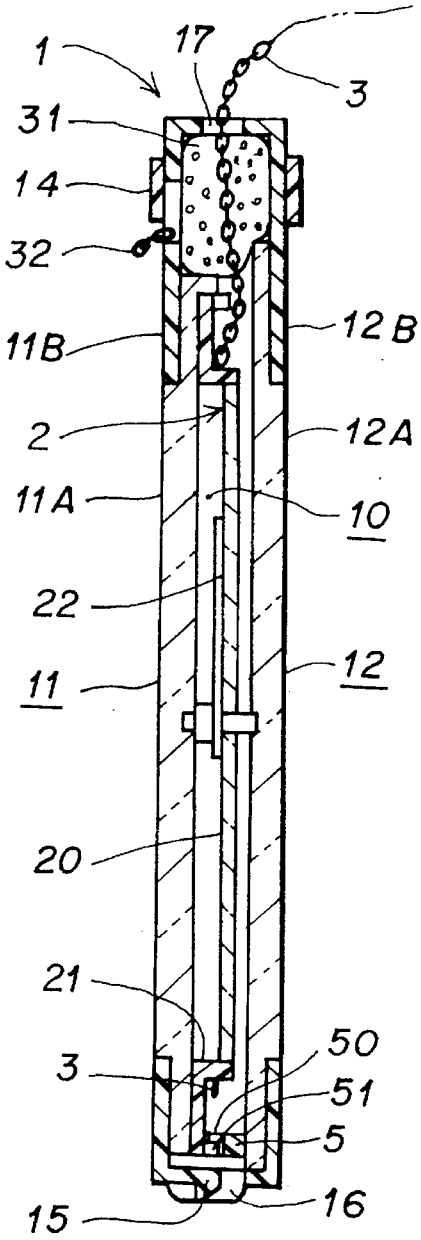
FIG. 5 is a sectional view taken along the line V—V in FIG. 2.
Figure 6:
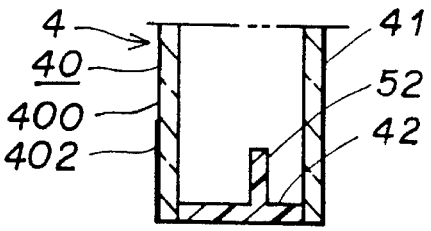
FIG. 6 is a sectional view taken along the line VI—VI in FIG. 2.

The mimic watch set for magic use according to the present invention is constructed as having been described in the foregoing. It is to be used as will be explained below:

First, the player takes the mimic watch 1 out of the protective case 4 and shows it the audience. The player has the audience confirm that the hour hand 22 points to "12" (12 o'clock), for example, as shown in FIG. 2 or any other hour numeral. At this time, the locking member is working to lock the chain 3 and rotary disk 2 against rotation as shown in FIGS. 5 and 8.

Next, the player puts the mimic watch 1 into the protective case 4 again with the front of the mimic watch 1 placed behind the front case member 40 while directing the front sides of the mimic watch 1 and protective case 4 toward the audience. At this time, only the hour numerals "1" to "12" in the mimic watch 1 are visible through the annular front transparent area 400 on the front case member 40 of the protective case 4. Also, since the chain 3 and rotary disk 2 have been unlocked, the chain 3 can be freely operated to rotate the rotary disk 2 as shown in FIGS. 5 and 9.

Then, the player asks the audience which is his or her most favorite one among the numerals "1" to "12". While watching the hour hand 22 through the rear transparent case member 41 of the protective case 4, the player should operate the chain 3 to rotate the rotary disk 2 until the hour hand 22 points at the audience-selected numeral. This operation should be done carefully for the audience not to be conscious thereof.

If the audience has answered any one of the numerals "1" to "6", for example, the player should pull the chain 3 in the direction of dashed-line arrow as shown in FIG. 10 to rotate the rotary disk 2 in the direction of dashed-line arrow (counterclockwise). When the hour hand 22 has come to that hour numeral, the player stops pulling the chain 3 in the direction of dashed-line arrow. If the most favorite numeral the audience has said is included in the numerals "7" to "11", the chain 3 should be pulled in the direction of solid-line arrow as shown in FIG. 10 to rotate the rotary disk 2 in the direction of solid-line arrow. When the hour hand 22 has reached the numeral, pulling the chain 3 in the direction of solid-line arrow should be stopped. If the audience has answered his or her most favorite numeral is "12", the chain 3 should not be pulled. The protective case 4 is not shown in FIG. 10.

During operation of the chain 3, only the hour numerals "1" to "12" on the central transparent cover 12A are visible to the audience through the annular front transparent area 400 while the hour hand 22 on the rotary disk 2 being rotating is not seen to the audience from outside because the protective case 4 containing the mimic watch 1 is directed at the front side thereof to the audience and thus the hour hand 22 is behind the opaque area 401.

After setting the hour hand 22 to the audience's favorite numeral, the player takes the mimic watch 1 out of the protective case 4 and shows it to the audience. Seeing the hour hand 22 of the mimic watch 1 points at the numeral the audience has said to the player, he or she will be given an illusion that the mimic watch 1 has automatically pointed to that numeral.

When taking out the mimic watch 1 from the protective case 4, the player may put the chain 3 on the audience's finger and have the audience hold it, and take off the protective case 4 from on the mimic watch 1. At this time, the locking member provided in this embodiment according to the present invention, is locking the chain 3 and rotary disk 2 so that the rotary disk 2 with the hour hand 22 may not possibly be rotated even if the chain 3 is pulled. Therefore, the trick of the mimic watch 1 will not possibly be revealed to the audience.

In the aforementioned embodiment, the chain 3 is used as the operating string loop. However, it should be noted that it may be any other string or filamentous member.

What is claimed is:

1. A mimic watch set for magic use to have a mimic watch point at a numeral the audience has selected from among hour numerals marked on a dial or a similar disk of the mimic watch, comprising:

a mimic watch with a rotary disk carrying an hour hand and an operating string loop; and a protective case for the mimic watch;

said mimic watch being composed of a front case frame/cover member and a rear case frame/cover member, which define together an inner space of said mimic watch, each of said front and rear case frame/cover members being composed of an opaque case frame portion and a central transparent cover portion, the central transparent cover portion of the front or rear case frame/cover member having twelve hour numerals "1" to "12" marked circumferentially thereon along said opaque case frame portion thereof, said hour numerals being in normal postures when viewed from the front of said mimic watch;

said rotary disk being composed of a central transparent disk portion corresponding to both said central transparent cover portions of said front and rear case frame/cover members, and an annular plate portion fixed to the circumference of said central transparent disk portion, said rotary disk being so disposed in the inner space of said mimic watch as to be rotatable about an axis thereof extending perpendicularly to, and through the centers of, said transparent disk portion thereof and said central transparent cover portions of said front and rear case frame/cover members, said rotary disk having an hour hand fixed on said transparent disk portion thereof, said hour hand extending radially from the center of rotation of said rotary disk to a position a little short of said hour numerals on said central transparent cover portion of said front or rear case frame/cover member;

said operating string loop being provided as wound inside said annular plate portion of said rotary disk inside said mimic watch said operating string loop being fixed at one place to said annular portion of said rotary disk, the portion of said string loop other than laid around said annular plate portion of said rotary disk being led out of said mimic watch;

said protective case being composed of an opaque front case member to cover said front case frame/cover member of said mimic watch, a rear case member and a side case member, said protective case being open at a portion of said side case member as well as between said front and rear case members so that said mimic watch can be put into and taken out of said protective case, said opaque front case member being partially transparent in a range through which it is possible to see said hour numerals marked on said central transparent cover portion of said front or rear case frame/cover member of said mimic watch, said rear case member being partially transparent in a range through which said hour numerals and hand can be seen from outside.

2. A mimic watch set for magic use as set forth in claim 1, further comprising a means provided between said mimic watch and rotary disk to block said rotary disk against any rotation in relation to said mimic watch, and a means of releasing said locking means from the locked state when said mimic watch is received in said protective case.

3. A mimic watch set for magic use as set forth in claim 1, further comprising a cushion member provided in said mimic watch to prevent a sound from being produced by a contact between said operating string loop and mimic watch when said operating string loop is operated.

4. A mimic watch set for magic use as set forth in claim 1, further comprising a mimic chain fixed at a portion of the front side of said mimic watch and which remains not moved when said operating string loop is operated to give an impression that said operating string loop is not operated.

* * * * *